United States Patent [19]

Eguchi et al.

[11] Patent Number: 4,700,644

[45] Date of Patent: Oct. 20, 1987

[54] SEWING MACHINE HAVING AN AUTOMATIC LOWER THREAD TENSION DEVICE

[75] Inventors: Yasukata Eguchi; Susumu Hanyu, both of Tokyo; Kazumasa Hara, Hino; Mikio Koike, Oume, all of Japan

[73] Assignee: Janome Sewing Machine Co. Ltd., Tokyo, Japan

[21] Appl. No.: 865,549

[22] Filed: May 20, 1986

[30] Foreign Application Priority Data

May 21, 1985 [JP] Japan ..... 60-107008

[51] Int. Cl.[4] ..... D05B 63/00; D05B 47/04

[52] U.S. Cl. ..... 112/255; 112/229

[58] Field of Search ..... 112/254, 255, 458, 97, 112/59, 229, 233

[56] References Cited

U.S. PATENT DOCUMENTS 4,215,641 8/1980 Dobrjanskyj et al. ..... 112/255 X
4,301,757 11/1981 Tonomura ..... 112/254
4,377,980 3/1983 Hanyu et al. ..... 112/458 X
4,632,048 12/1986 Matsubara ..... 112/255 X
4,638,751 1/1987 Hanyu et al. ..... 112/254

FOREIGN PATENT DOCUMENTS 60-83696 5/1985 Japan ..... 112/254

*Primary Examiner*—Peter Nerbun
*Attorney, Agent, or Firm*—Michael J. Striker

[57] ABSTRACT

When a lower thread is effected with tension by an upper thread, a lower thread tension device is actuated in a certain working distance with very small resistance to an extent that a lower thread is drawn as if without resistance. If the lower thread is effected with said tension outside of said distance, it is not drawn out with large resistance. An actuation means successively receives information about thread consumed in each of the stitches and information about rotation phase of the sewing machine from a phase sensor. In the distance of a strong resistance, the lower thread is prohibited from drawing, and the thread is tightened in this distance.

7 Claims, 8 Drawing Figures

(7) : Upper thread consuming information (Image sensor)

25 : Calculation of upper thread consumption

27 : Control of energization

(16) : Lower thread tension device (Electromagnetic coil)

(7) : Upper thread consuming information (Image sensor)

25 : Calculation of upper thread consumption

27 : Control of energization

(16) : Lower thread tension device (Electromagnetic coil)

1
3
5
(5)
8
9
14
20
21
22
23
24
X
X1
X2
X3
X4

SEWING MACHINE HAVING AN AUTOMATIC LOWER THREAD TENSION DEVICE

BACKGROUND OF THE INVENTION

The present invention relates to a sewing machine which automatically controls a lower thread tension.

There have been proposed many automatic methods of controlling upper thread tension or a supply amount in response to type of fabrics, threads, needle amplitude widths or fabric feeds, so that an upper thread and a lower thread cross appropriately in a fabric under stitching to provide satisfactory stitches. However, especially in thin fabric, due to fabric shrinkage and other inconveniences, it has not been always sufficient to adjust the upper thread tension only.

SUMMARY OF THE INVENTION

When a lower thread is effected with tension by an upper thread, a lower thread tension device is actuated. Within a certain working distance there is a very small resistance such that a lower thread is drawn out as if without resistance. If the lower thread is effected with said tension outside of said distance, it is now drawn out because of large resistance. An actuation means successively receives information about thread consumed in each of stitches and information about a rotation phase of the sewing machine from a phase sensor. In said distance of the strong resistance, the lower thread is prohibited from drawing, and the thread is tightened in this distance.

DETAILED DESCRIPTION OF PREFERRED EMBODIMENT OF THE INVENTION

Figure 3:
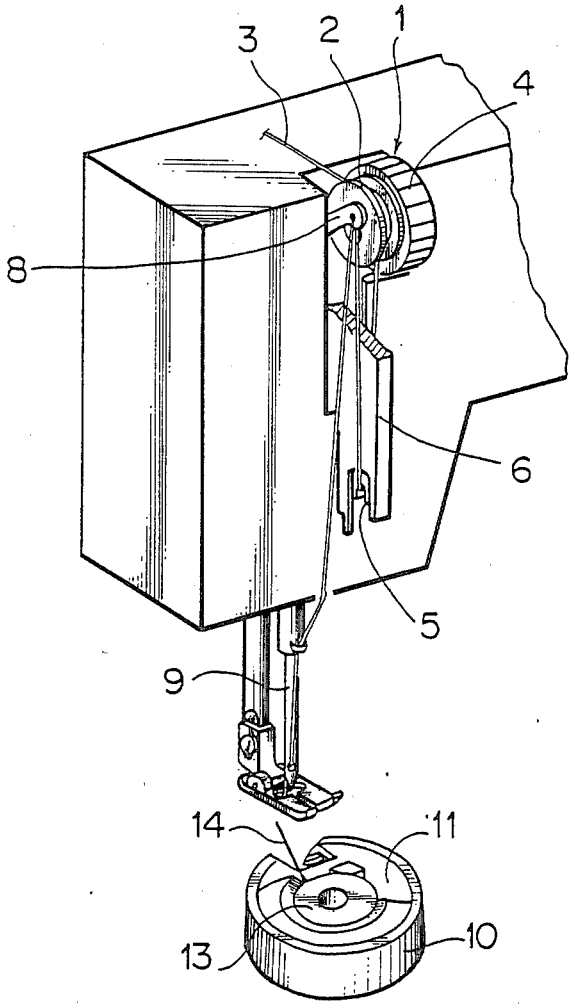
FIG. 3 is a perspective view of an element part of the sewing machine.

In FIG. 3, an upper thread tension device 1 holds an upper thread 3 in a thread tension disc 2, and said holding may be manually controlled by a thread tension dial 4. Except when a special stitching condition is required, the tension device 1 is used at a standard adjusting position. A thread catching spring 5 is provided within a thread guide body 6 and is displaced upward in response to the tension of the upper thread 3.

Figure 4:
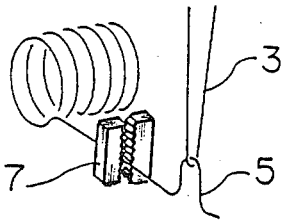
FIG. 4 is a view of attaching an image sensor.
Figure 5:
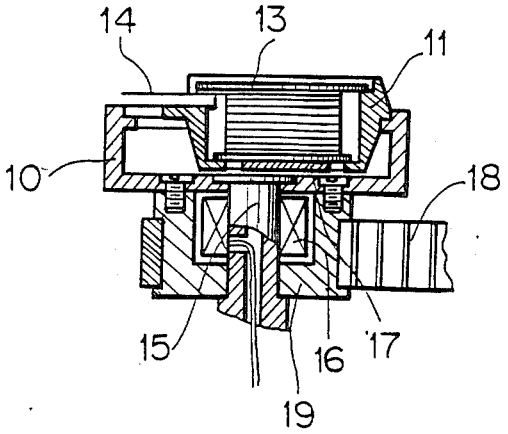
FIG. 5 is a cross sectional view of a structure relative to the lower thread tension device.

An image sensor 7 shown in FIG. 4 detects displacements in vertical directions of the thread catching spring 5. An upper thread 3 runs via the thread tension disc 2, thread catching spring 5, take-up lever 8 and needle 9. A loop taker 10 holds a bobbin carrier 11 therein, and the latter carries a bobbin 13 therein for supplying a lower thread 14. As shown in FIG. 5, an electromagnetic coil 16 as a lower thread tension device is wound for a supporting shaft 15 constituting a magnetizable body under the loop taker 10. On the other hand, a magnetizable material 17 is provided opposite the supporting shaft 15 under the bobbin 13. If the current of the electromagnetic coil 16 is controlled by a later mentioned actuation control means, friction between the bobbin 13 and the bobbin carrier 11 is controlled to provide a very small resistance, e.g., about 5 g such that the lower thread 14 is drawn by the tension of the upper thread 3 and to provide a strong resistance such as the lower thread 14 is not drawn out thereby. A clip belt 18 causes a belt pulley 19 to rotate the loop taker 10.

Figure 1:
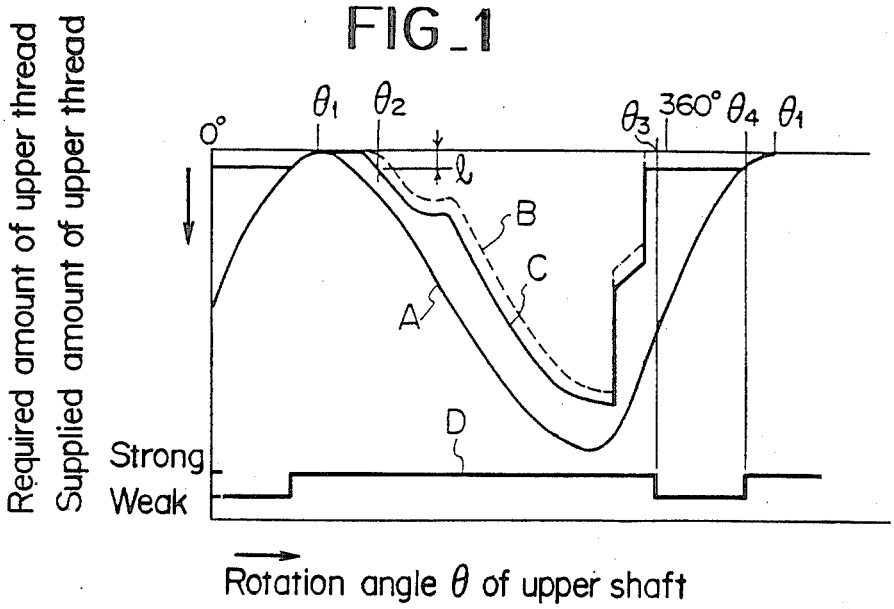
FIG. 1 is an actuation timing curve of the supplied thread and a lower thread tension device, showing an embodiment of the invention.
Figure 2:
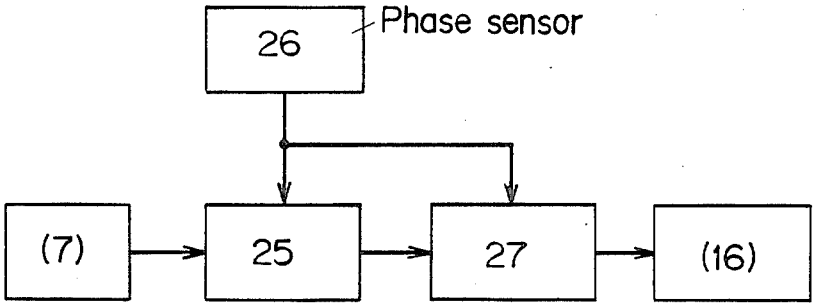
FIG. 2 is a block diagram of control.
Figure 6:
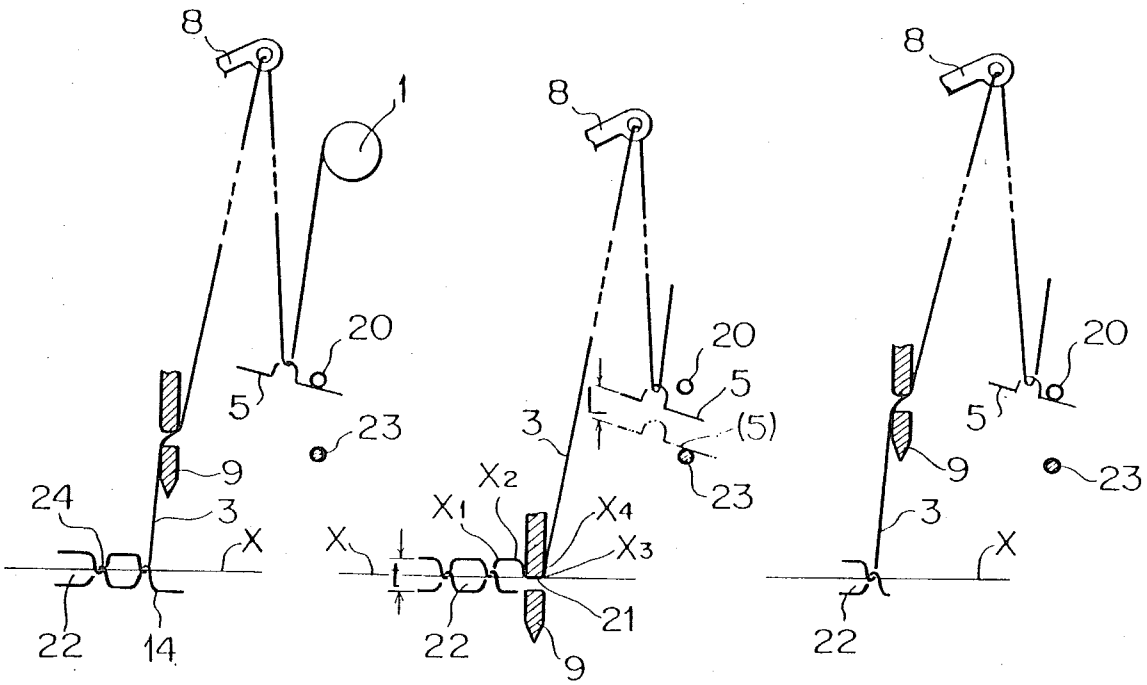
FIGS. 6(1), 6(2), and 6(3) are explanatory views for forming stitches.

FIG. 1 shows actuation timings curves of the supplied thread and the lower thread tension device, and an actuation control thereof is shown in a control block diagram of FIG. 2. In FIG. 1, a lateral axis $\theta$ shows rotation angle (phase) of an upper shaft (30) where an upper dead point of a needle 9 is 0°. A curve (A) shows the supply amount of the upper thread by a take-up lever 8 which is appropriate for the sewing machine. Curves (B), (C) are the required amounts of the upper thread in the loop taker 10, and the curve (B) shown with a dotted line is assumed when the fabric thickness of FIG. 6 is t, feed is P and zigzag width is O which are each appropriate for the sewing machine. The curve (C) shows that the required amount of the upper thread is increased by l in correspondence to the consumed amount l to be used for stitches by the fabric thickness t and the fabric feed P. An actuation line (D) shows strong energization and a weak one for the electromagnetic coil 16. The strong energization corresponds to the strong resistance against the drawing of the lower thread and the weak energization corresponds to the very small resistance. FIG. 6 shows the stitching conditions of the respective phases in FIG. 1 when thickness is t and feed is P, and the conditions of the take-up lever 8 and the thread catching spring 5.

FIG. 6(1) is a condition of the phase $\theta 1$, where the take-up lever 8 is stopped at the upper dead point while the needle 9 moves down. At this time, the curves (A) and (C) coincide and the thread catching spring 5 is stopped at an upper stopper 20, and the upper thread 3 is drawn from a thread supply (not shown).

FIG. 6(2) is a condition coinciding with the phase $\theta 2$ where the curve (B) is 0. Phase $\theta 2$ is a phase where the upper part 21 of the needle eye is at a determined center of the fabric (called it as "relative phase"), and said upper part 21 coincide with the center line (X) in the thickness t of the fabric 22. The take-up lever 8 and the needle 9 move down. In the phase $\theta 2$, since the upper thread 3 is relaxed, the thread catching spring 5 is at the lower position. This position further declines when the fabric thickness t and the fabric feed P are small, and the condition of the thickness $t=0$ and the feed $P=0$ is the lowest position (called it as "standard condition"). Then, the thread catching spring 5 reaches an engaging position with the lower stopper 23 as shown with the dotted line.

The image sensor 7 detects displacement L of the spring 5 in an original point of said engaging position, and this displacement will be used as an upper thread consuming information. The increase in consumption of the upper thread (consuming amount of the upper thread) per stitch by the thickness t and the feed P for the standard condition, is segments X1–X2–X3–X4 where the upper thread 3 goes from a shoulder (X1) of the fabric 22 to a shoulder (X4) via points (X2), (X3). This value is identical with the amount l of consuming the upper thread, and it is almost twice of the displacement L of the thread catching spring 5. Actually, for calculation of the upper thread consuming amount, influences by the presser metal 23 and others are taken into consideration and an accommodation is made. The phase θ3 is such a phase where a distance from a phase θ4 is fixedly set to be adjusted necessarily and enough for drawing the lower thread 14, after the upper thread has been released from the loop taker and the curve (B) has been 0. Subsequently, in a period coming to the phase θ4, the electromagnet 16 is effected with weak energization and will provide very small resistance against the drawing of the lower thread.

FIG. 6(3) is a condition of the phase θ4 where the curve (C) crosses with the curve (A), and the needle 9 is on the way of descending prior to the condition of FIG. 6(1). The take-up lever 8 moves upward and the thread catching spring 5 is stopped at the upper stopper 20 so that the drawing-up is finished for the upper thread 3 having laxation under the fabric and the thread is tightened.

The phase θ4 is changed by the upper thread consuming amount l. In this phase, the electromagnetic coil 16 is effected by strong energization and will provide strong resistace to prohibit the drawing of the lower thread 14. In a distance going to the phase θ1, the tension of the upper thread 3 by the upper thread tension device 1 acts to tighten the lower thread.

The phase θ4 is set under a condition so that the crossing point 24 is at the center of the fabric 22. On the other hand, a phase where the electromagnetic coil 16 is switched from the weak energization to the strong energization, is moved prior to the phase θ4 in order to provide the crossing point 24, for example, under the center line (X) in response to type of stitching.

FIG. 2 is a control block diagram, and each of the controls depends upon the microcomputer. The upper thread consuming amount (l) is calculated to provide an output by a calculation means 25 which receives a rotation phase signal of the upper shaft and upper thread consumption information (7) at a determined phase to produce an output (at this point in time, the upper thread consuming amount (l) is based on the displacing data of the image sensor). Said output may also depend upon an independent detection of the fabric thickness from the vertical positions of the presser metal 23 or upon the information about the fabric thickness and the fabric feed from a memory of the microcomputer when a stitching is selected.

An energization control means 27 receives the data from the phase sensor 26 and the calculation means 25 of the upper thread consumption amount (l), calculates the phase θ4 with the characteristics of the curve (A), and sets the switching point of the electromagnetic coil 16 from the weak energization to the strong energization, or sets said switching point in accordance with the stitching conditions for position designations of the crossing point 24 so as to actuate switchings of said energization and the phase θ3.

According to the invention, the lower thread is drawn with a weak tension in a distance for requiring the drawings of the lower thread, so that the fabric is not effected with exceeding force, and the upper thread tension may be set weakly by the upper thread tension device in accordance with said tension of the lower thread, so that the fabric is not caused with shrinkage.

With respect to the tightening of the thread, the drawing of the lower thread is prohibited which is completely absorbed in the relaxation phase θ4, and the upper thread is effected with tension, so that the stitches are therefore made exact.

What is claimed is:

1. A sewing machine device having lower thread tension control comprising:

means for concatenating an upper and lower thread in a fabric to be stitched so as to form a concatenation point where the upper and lower threads cross each other in the fabric and including a needle with an needle eye and which is reciprocably movable to penetrate the fabric to be stitched, a take-up lever which is reciprocably movable to tension the upper thread when moving in one direction and to slacken the upper thread when moving a direction opposite said one direction and which is movable to deadpoints when changing said directions, a loop taker with a hook and which is rotatably movable and formed to releasably catch the upper thread with said hook during rotation thereof, means for drawing out the lower thread and including a bobbin freely rotatable in said loop taker and being formed to releasably hold a supply of the lower thread so that the lower thread can be drawn out of the bobbin when the lower thread is tensioned, and an upper shaft operatively connected with said needle, said take-up lever and said loop taker for timingly driving the same, said upper shaft being rotatable through a plurality of angular positions constituting regions of said angular positions between a plurality of phases, the fabric having a center constituting a desired location for the concatenation point, said needle eye being formed for receiving the upper thread therethrough and having an upper end contacting said upper thread when said needle moves toward the fabric, said concatenating means being movable through a plurality of said phases including at least four of said phases (θ1, θ2, θ3, θ4) to form each stitch in the fabric to be stitched, said four phases constituting a first (θ1), a second (θ2), a third (θ3) and a fourth (θ4) phase, said first phase (θ1) arising when said needle moves toward the fabric to be stitched for penetrating the fabric and simultaneously draws out the upper thread and said take-up lever is stopped at a dead point after having moved in said one direction, said second phase (θ2) arising when said upper end of said needle eye is at said desired location of said center of said fabric to be stitched and said needle moves in said opposite direction to thereby slacken the upper thread, said third phase (θ3) arising immediately after the upper thread is released by said hook of said loop taker, said loop taker being formed to catch the upper thread to concatenate with the lower thread after the upper end of needle eye passes through the fabric to be stitched, said fourth phase (θ4) arising when said take-up lever moves in said one direction and has brought the concatenation point to said desired location in the fabric to be stitched; and means for tensioning the lower thread to provide resistance to a drawing out of the lower thread between said first and said third phases and said fourth and said first phases, but not between said third and said fourth phases, said take-up lever being formed to bring the concatenation point to the center of the fabric to be stitched for said fourth phase and to draw out a predetermined amount of upper thread (l) to tighten the stitch between said fourth and said first phases.

2. A device as defined in claim 1, further comprising:

means responsive to an amount consumed by said upper thread to form each stitch and including means for absorbing a slackening of the upper thread during movement of said take-up lever in said opposite direction.

3. A device as defined in claim 2, wherein the fabric has a thickness and a fabric feeding pitch, said absorbing means includes a thread checking spring means catchable with the upper thread and stopper means including an upper and lower stopper spaced apart from each other, said spring means biasing toward said lower stopper to absorb said slackening of the upper thread and movable toward said lower stopper in dependence upon the thickness and the fabric feeding pitch of a fabric to be stitched so that a position of said spring means between said stoppers is indicative of said absorbed slackening and therefore an amount of upper thread consumed to form each stitch, said stoppers being arranged relative to each other so that said spring means moves toward said upper stopper when the upper thread is tensioned by said take-up lever to actually contact said upper stopper during said first and fourth phases and said spring means moves toward said lower stopper when the upper thread is slackened by said take-up lever to actually contact said lower stopper when the thickness and the fabric feeding pitch of the fabric are zero.

4. A device as defined in claim 3, further comprising:

means for detecting said angular positions of the upper shaft as the upper shaft rotates at least between said third ($\theta 3$) and said first ($\theta 1$) phases and including a phase sensor transmitting a position signal indicative of of said detected angular position;

means for detecting a relative position of said spring means between said two stoppers and including a displacement sensor transmitting a consumed amount signal indicative of said amount of upper thread consumed;

calculation means storing data representing consumed amounts of the upper thread in forming stitches, said calculating means responsive to said position signal for a corresponding one of said angular positions corresponding to said second phase ($\theta 2$) and being formed to thereby compare said consumed amount signal with said data and produce an output of said data corresponding to said consumed amount signal; and actuation control means storing other data representing variations of motion of said take-up lever corresponding to an amount of the upper thread supplied to said loop taker in said regions between said third phase ($\theta 3$) and said first phase ($\theta 1$), each of said variations corresponding to a respective one of said angular positions of said upper shaft in said regions, said actuation control means being formed to produce a drive signal actuating said lower thread tension means to exert a resistance against a drawing out of the lower thread, said drive signal resulting from a correspondence between said output and one of said other data stored in said actuation control means thereby producing said drive signal at said angular position of said upper shaft corresponding to said fourth phase ($\theta 4$) as determined by an amount consumed (l) of the upper thread, said drive signal also being formed to produce a stop drive signal for de-actuating said lower thread tension means so that said resistance to said drawing out of the lower thread is removed, said stop signal being produced during said third phase ($\theta 3$).

5. A device as defined in claim 4, further comprising:

a bobbin carrier supporting said bobbin so as to have a friction therebetween, said lower thread tensioning means including means for enhancing said friction between said bobbin and said bobbin carrier and including an electromagnetic coil responsive to said drive signal and said stop signal of said actuation control means to control said enhancing means.

6. A device as defined in claim 5, further comprising:

a support shaft supporting said loop taker, said controlling friction means including a magnetizeable material contacting said bobbin thereunder and being arranged opposite said support shaft, said support shaft being formed of a magnetizeable body material, said magnetizeable materials being responsive to said electromagnetic coil to control said friction.

7. A device as defined in claim 1, further comprising:

a bobbin carrier supporting said bobbin so as to have a friction therebetween, said lower thread tensioning means including means for controlling said friction between said bobbin and said bobbin carrier.

* * * * *